US005110622A

United States Patent [19]

Hasegawa et al.

[11] Patent Number: 5,110,622

[45] Date of Patent: May 5, 1992

[54] PROCESS FOR PREPARING A METAL SULFIDE THIN FILM

[75] Inventors: Yo Hasegawa, Nara; Kazuyuki Okano, Ikoma; Yasuhito Isozaki, Neyagawa; Munehiro Tabata, Ibaragi; Chiharu Hayashi; Akira Nakanishi, both of Hirakata, all of Japan

[73] Assignee: Matsushita Electric Industrial Co., Ltd., Osaka, Japan

[21] Appl. No.: 445,663

[22] PCT Filed: Apr. 19, 1989

[86] PCT No.: PCT/JP89/00419

§ 371 Date: Dec. 4, 1989

§ 102(e) Date: Dec. 4, 1989

[87] PCT Pub. No.: WO89/10326

PCT Pub. Date: Nov. 2, 1989

[30] Foreign Application Priority Data

Apr. 21, 1988 [JP] Japan ..... 63-98664

[51] Int. Cl.[5] ..... B05D 5/12

[52] U.S. Cl. ..... 427/126.1; 427/57; 427/64; 427/126.2; 427/226; 239/4

[58] Field of Search ..... 427/226, 126.1, 126.2, 427/64, 57; 239/102.2, 338, 4

[56] References Cited

U.S. PATENT DOCUMENTS

| | | | |
|---|---|---|---|
| 2,905,574 | 9/1959 | Spengler et al. | 427/226 |
| 3,148,084 | 9/1964 | Hill et al. | 427/64 |
| 3,243,122 | 3/1966 | Snaper | 239/102.2 |
| 4,360,542 | 11/1982 | Loeffler et al. | 427/75 |
| 4,724,161 | 2/1988 | Coutts et al. | 427/57 |

FOREIGN PATENT DOCUMENTS

| | | |
|---|---|---|
| 1297777 | 5/1962 | France . |
| 61-166979 | 7/1986 | Japan . |

OTHER PUBLICATIONS

English language abstract of Japanese Patent Publication #61-166979.

*Primary Examiner*—Shrive Beck
*Assistant Examiner*—Alain Bashore
*Attorney, Agent, or Firm*—Panitch, Schwarze, Jacobs & Nadel

[57] ABSTRACT

A uniform and dense (non-porous) thin film of metal sulfide with excellent electric characteristics can be prepared by making into a fine mist an organic compound alone or dissolved in a solvent the organic compound containing at least one metal-sulfur bond in the structure thereof, and spraying the organic compound on a heated substrate.

1 Claim, No Drawings

PROCESS FOR PREPARING A METAL SULFIDE THIN FILM

TECHNICAL FIELD

The present invention relates to a process for preparing metal sulfide thin films, and more particularly, to a process for preparing metal sulfide thin films which are used for various devices such as photodetectors and display devices in the field of electronics.

BACKGROUND ART

Previously, thin films of metal sulfide such as zinc sulfide, cadmium sulfide and lead sulfide, which are used for various devices such as sensors, optoelectric transducers, and display devices, were prepared principally using a vacuum method such as vacuum deposition or sputtering. However, the vacuum method has the disadvantages of high machinery cost and of low productivity, and therefore, a process for preparing inexpensive thin films of metal sulfide with high performance has been desired.

As methods to eliminate the above-discussed disadvantages, the following processes have been proposed, including the so-called spray method in which an inorganic metal salt and a soluble salt containing sulfur or selenium are sprayed on a substrate heated to an elevated temperature, as disclosed in the specification of U.S. Pat No. 3,148,084 (Sep. 8, 1964); a process for preparing thin films by the reaction of different compounds containing, respectively, a metal and sulfur (one of the compounds may be a gas), as disclosed typically in the specification of French Patent No. 1,297,777 (May 28, 1962); and a process by the application and thermal decomposition of a solution of complexes consisting of an organic ammonium salt and a sulfur compound, as exemplified in U.S. Pat No. 2,905,574 (Sep. 22, 1959).

The inventors of the present application found that a uniform thin film of metal sulfide with excellent characteristics can be prepared by applying to a substrate, an organic compound containing at least one metal-sulfur, bond in the structure thereof, and then thermally decomposing the compound in an inert atmosphere, as disclosed in the Japanese Laid-Open Patent Publication No. 61-166979 (Jul. 28, 1986), corresponding to a patent application which was already filed and laid open as a method to eliminate the disadvantages of the conventional inventions.

However, the above-mentioned conventional processes for preparing metal sulfide thin films have disadvantages, and therefore, it is difficult in many cases to use the obtained film as a thin film for electronics which is one objective of the present invention. That is, the spray method has the following problems: the uniformity of the films prepared is poor and the characteristics of the films tend to fluctuate; in cases where thin films are obtained by the reaction of two different compounds, uniform thin films can not readily be obtained, or the use of a special atmosphere and sometimes of highly toxic gases is essential.

Moreover, in the process for preparing metal sulfide thin films according to the above-mentioned invention by the present inventors, there is the problem that it may be difficult to use the film in applications where an electric field is applied to the film, because the film has a tendency to become porous in the ultrafine structure, although the uniformity of the film is excellent.

DISCLOSURE OF THE INVENTION

The present invention, which overcomes the above-discussed disadvantages, is a process for preparing metal sulfide thin films by making into a fine mist an organic compound alone or dissolved in a solvent, the organic compound containing at least one metal-sulfur bond in the structure thereof, and spraying the fine mist of an organic compound alone or dissolved in a solvent on a heated substrate. It is desirable that the organic compound containing at least one metal-sulfur bond in the structure thereof has a vapor pressure at room temperature or at a temperature not exceeding the thermal decomposition temperature of the compound.

According to the above-mentioned process, it is possible to obtain uniform and dense (non-porous) thin films of metal sulfide with excellent electric characteristics.

BEST MODE FOR CARRYING OUT THE INVENTION

The following describes the most suitable materials and process which can be used in the present invention.

As the organic compound containing at least one metal-sulfur bond in the structure thereof which can be used in the present invention, any known compounds of such a structure can be employed, examples of which include various metal mercaptides (metal thiolates), metal salts of thiocarboxylic acids, metal salts of dithiocarboxylic acids, metal salts of thioglycolic acids, metal salts of thioglycolic acid esters, and so on.

The organic compound containing at least one metal-sulfur bond in the structure thereof, alone or dissolved in various solvents, is made into a fine mist and sprayed on a heated substrate, so that it can be thermally decomposed and deposited on the substrate as a thin film of metal sulfide. Although the above-mentioned compound can be used in the form of liquid or solid, it is preferred that the compound has a vapor pressure at a temperature not exceeding the thermal decomposition temperature thereof in order to obtain a more uniform and denser film.

A means for making the compound or a solution of the compound into a fine mist is well known in the art. It is usually convenient, but not limited, to use ultrasonic vibrations.

The process according to the present invention appears similar to the so-called "mist method" used in the preparation of metal oxide thin films. However, the process for preparing metal sulfide thin films according to the present invention has not yet been revealed, and therefore, it can be said that the present invention provides a novel process for preparing metal sulfide thin films.

EXAMPLES

The invention will be further explained by the following examples.

EXAMPLE 1

Zinc-ter-nonylthiolate was dissolved in an aromatic solvent. The solution obtained was made into a fine mist by means of ultrasonic vibration and sprayed on a glass plate heated to 500° C., in a stream of argon, resulting in a uniform, colorless and transparent thin film formed on the glass plate. The results of analysis using an X-ray diffraction apparatus for thin films indicated that the film was composed of hexagonal crystals of zinc sulfide. The observation using a high resolution electron microscope indicated that the film was a uniform film like single crystals.

COMPARATIVE EXAMPLE 1

The same solution as used in Example 1 was spin-coated on a glass plate. After drying, a film was obtained by thermal decomposition at 500° C. in a stream of argon. The results of X-ray analysis of this film were similar to those obtained in Example 1. However, the observation using a high resolution electron microscope indicated that the film was an aggregate of fine particles with a diameter of several hundred angstroms with spaces between the particles.

EXAMPLE 2

With the use of zinc-ter-dodecylthiolate in place of zinc-ter-nonylthiolate, a uniform zinc sulfide film similar to that of Example 1 was obtained.

EXAMPLE 3

With the use of zinc-2-ethylhexylthiolate in place of zinc-ter-nonylthiolate, a uniform zinc sulfide film similar to that of Example 1 was obtained.

EXAMPLE 4

In the same manner as in Example 1, except that cadmium-ter-nonylthiolate was used in place of zinc-ter-nonylthiolate, a uniform film of pale yellow was obtained. The results of analysis using an X-ray diffraction apparatus indicated that the film was made of cadmium sulfide. The measurement of the photoconductivity of this film found a photocurrent with a peak at 480 nm.

EXAMPLE 5

In the same manner as in Example 1, with the use of indium-ter-nonylthiolate in place of zinc-ter-nonylthiolate, a uniform film of pale brown was obtained. The results of analysis using an X-ray diffraction apparatus indicated that the film was made of indium sulfide.

EXAMPLE 6

In the same manner as in Example 1, with the use of tin-ter-nonylthiolate in place of zinc-ter-nonylthiolate, a uniform, colorless and transparent film was obtained. The results of analysis using an X-ray diffraction apparatus indicated that the film was made of tin sulfide.

EXAMPLE 7

In the same manner as in Example 1, with the use of a zinc salt of n-butyl thioglycolate in place of zinc-ter-nonylthiolate, a uniform, colorless and transparent film was obtained. The results of analysis using an X-ray diffraction apparatus indicated that the film was made of zinc sulfide.

EXAMPLE 7

In the same manner as in Example 1, except that zinc-ter-nonylthiolate (liquid) was used alone in place of the solution of zinc-ter-nonylthiolate, a uniform zinc sulfide film similar to that of Example 1 was obtained.

INDUSTRIAL APPLICABILITY

As described above, the process for preparing metal sulfide thin films according to the present invention makes it possible to prepare high-quality thin films of metal sulfide with high productivity, which can therefore be of great value in industry.

We claim:

1. A process for preparing a metal sulfide thin film, wherein an organic compound alone or dissolved in a solvent is made into a fine mist and sprayed on a heated substrate, said organic compound being at least one selected from the group consisting of metal mercaptide, metal thiocarboxylate, metal dithiocarboxylate, metal thioglycolate and metal salt of thioglycolate ester.

* * * * *